US006076805A

United States Patent [19]

Messersmith

[11] Patent Number: 6,076,805

[45] Date of Patent: Jun. 20, 2000

[54] ROPE PULLING DEVICE

[76] Inventor: David Messersmith, 101 Musgrave Rd., Colfax, Wash. 99111

[21] Appl. No.: 09/382,322

[22] Filed: Aug. 24, 1999

[51] Int. Cl.[7] ..... B21F 9/00

[52] U.S. Cl. ..... 254/218; 254/221; 254/237; 254/243; 254/253

[58] Field of Search ..... 254/199, 218, 254/221, 223, 237, 243, 245, 250, 253, 254

[56] References Cited

U.S. PATENT DOCUMENTS

| | | | |
|---|---|---|---|
| 291,955 | 1/1884 | Sunderland | 254/218 |
| 341,273 | 5/1886 | Perry | 254/218 X |
| 358,138 | 2/1887 | Ainsworth | 254/223 X |
| 398,596 | 2/1889 | Enyeart | 254/221 |
| 403,620 | 5/1889 | Stiles | 254/221 |
| 446,790 | 2/1891 | Ridder et al. | 254/237 |
| 616,176 | 12/1898 | Zimmerman | 254/199 X |
| 658,132 | 9/1900 | Thomson, Jr. | 254/218 X |
| 662,133 | 11/1900 | Passmore | 254/223 X |
| 1,147,655 | 7/1915 | Snelling | 254/237 |
| 1,179,825 | 4/1916 | Greutmann | 254/237 X |
| 2,506,029 | 5/1950 | Maasdam | 254/218 X |
| 3,348,812 | 10/1967 | Story | 254/223 |
| 3,825,228 | 7/1974 | Greutman | 254/237 |
| 4,027,359 | 6/1977 | Tinker . | |
| 4,235,420 | 11/1980 | Ross et al. | 254/218 |
| 5,314,043 | 5/1994 | Evezard et al. | 254/199 X |
| 5,431,371 | 7/1995 | Daniels et al. | 254/218 |

*Primary Examiner*—Donald P. Walsh
*Assistant Examiner*—Emmanuel M. Marcelo
*Attorney, Agent, or Firm*—David S. Thompson

[57] ABSTRACT

A rope pulling device includes a come-along (20) having a frame (30) on which are mounted an anchor end grip assembly (200) and a load end grip assembly (300). During operation, the anchor end grip assembly is locked on the rope. A hook (100) is carried on the spindle (62) of the ratchet assembly (60). A lever assembly (50) drives a pawl assembly (80) which rotates the ratchet assembly in the forward direction. The hook causes rope to move through the unlocked load end grip assembly and to wind about the spindle. When the spindle is full, the load end grip assembly is locked. A lock assembly (70), which prevents counter-rotation of the spindle is released, allowing the spindle to be reversed and emptied. Slack rope is then passed around the hook, and wound about the spindle for approximately two turns. The load end grip assembly may then be released and the spindle may again be filled with rope, thereby pulling the load (400) closer to the anchor (500).

3 Claims, 4 Drawing Sheets

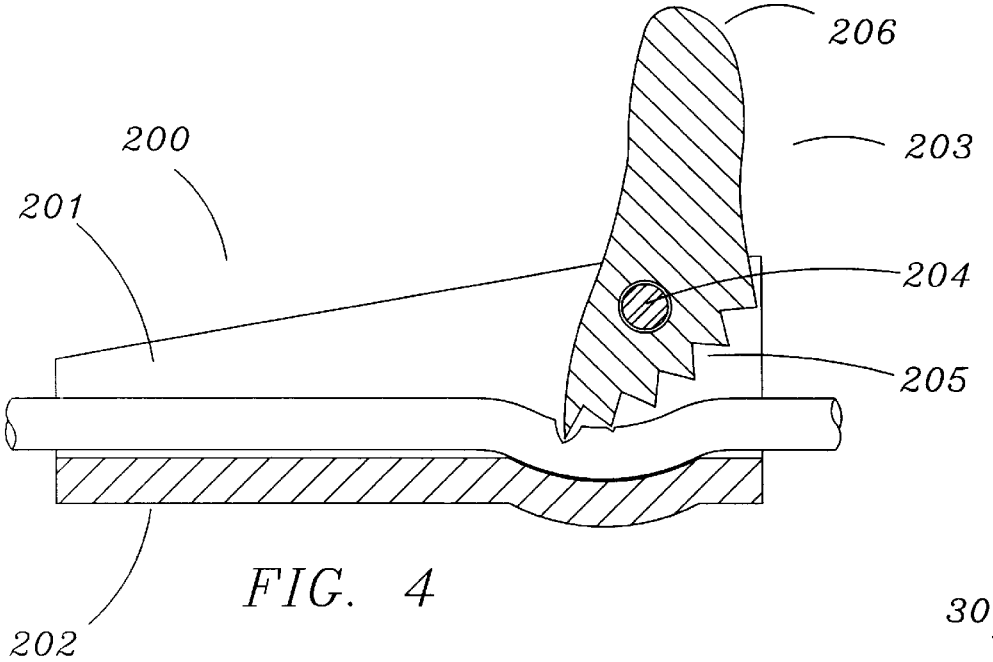
FIG. 4
FIG. 5
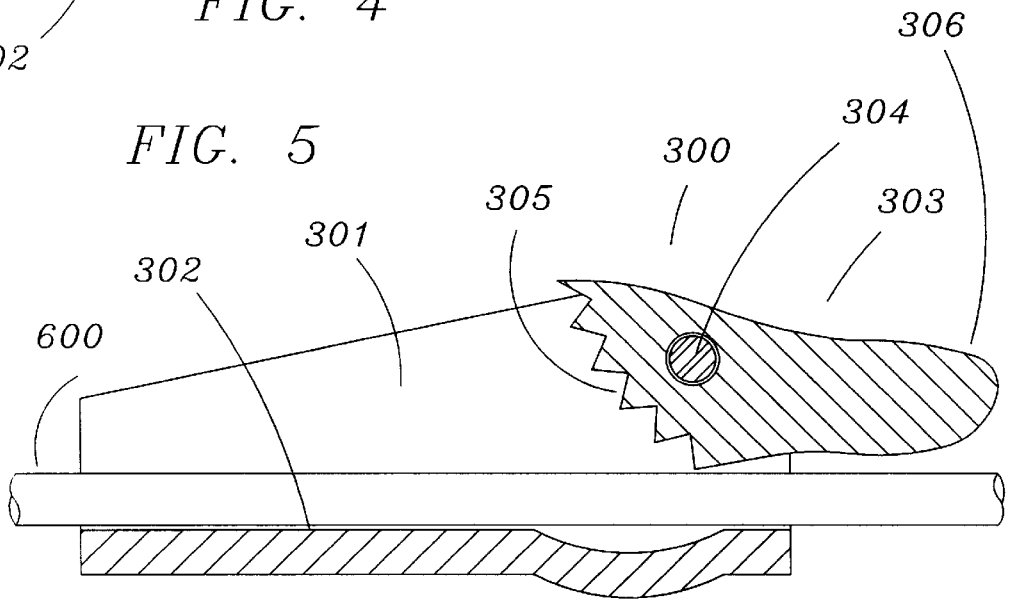

ROPE PULLING DEVICE

CROSS-REFERENCES

There are no applications related to this application filed in this or any foreign country.

BACKGROUND

The use of a cable-pulling device commonly called a "come-along" is well-known. Such devices are used with one cable extending from each end of the device. A first end of an anchoring cable is attached to a first end of the come-along and a second end of the anchoring cable is attached to an anchoring object. A load-pulling cable has a first end wrapped one or more turns about a spindle within the come-along and a second end attached to a load to be moved. Using well-known lever-arm principles and a ratchet and pawl structure, a greater length of the first end of the second cable is wound around the spindle, thereby pulling the load toward the come-along.

Unfortunately, where the length of the cable wound around the spindle is less than the distance that it is desired to move the load, the load must be temporarily secured to the anchor using a temporary cable. The first load-pulling cable may then be removed from the come-along. A second load-pulling cable, shorter than the first load pulling cable, may then have a few inches of one end wrapped about the come-along's spindle and a second end attached to the load. With the second load-pulling cable in place, the load may be pulled until the spindle is again full. This is process is repeated until the load is correctly positioned.

The problem with this approach is that it is frequently the case that the load will need to be moved a distance greater than a distance associated with the length of cable which may be wrapped about the spindle of the come-along. Thus, the movement of the load is done in a series of repeated exercises, each iteration moving the load by an incremental distance associated with the length of the cable which may be wrapped about the spindle. Additionally, since the load-bearing cable wrapped about the spindle must be unwound, additional cables are typically required to hold the load in position while the come-along is again readied for use. This is usually the case, such as in the common example where the load is positioned half-way up a hillside.

Therefore, it is usually the case that a first cable is required to anchor the come-along, and at least one load-bearing cable is required to extend from the come-along to the load. An additional anchoring cable is required to secure the load and prevent its moving while the load-bearing cable is readjusted between iterations. Additional cables of alternate lengths may be advantageous, since the end of the cable to be wrapped about the spindle of the come-along is excessively long, an excessive portion of the spindle is filled before the load begins to move.

It is also the case that considerable effort must be expended when using a come-along in hiking up and down the hillside between the anchor and the load. For example, where the load is a snowmobile stuck at the bottom of a hillside, and the anchor is a pickup truck on a road at the top of the hillside, numerous trips will have to be made between the come-along, snowmobile and truck.

What is needed is a device having the load-moving advantages of the come-along, but which is adapted for use with just one rope. The device should be attachable to any middle point of a rope extending between the load to the anchor. The device should eliminate the need to secure the load with an additional line during the period of time in which the spindle is emptied.

The present invention is directed to an apparatus that satisfies the above needs. A novel rope pulling device is disclosed that is adapted to move a load toward an anchor wherein a single rope connects the load to the anchor and the device is attached to any middle point on the rope.

The rope pulling device of the present invention provides some or all of the following structures.

(A) A preferred come-along includes the following components.

(a) A frame is generally oriented in a lengthwise manner, having an anchor end and a load end. Two opposed side rails are connected by anchor end, load end and center axles, and are separated by a distance sized to contain the lever, ratchet, lock and pawl assemblies.

(b) A lever assembly, carried by the center axle, supports a pawl assembly in a position where it may engage the ratchet assembly.

(c) A ratchet assembly is carried between the opposed side rails of the frame on the center axle. A ratchet is carried at one end of the axle, where it may be engaged by the pawl assembly carried by the lever assembly. A spindle, also carried on the center axle, is sized to carry a length of rope.

(d) A pawl assembly, carried by the lever assembly, is switchable between a winding and an unwinding mode. In the winding mode, a pawl engages the ratchet, forcing it to turn in the forward direction. In the unwinding mode, the pawl is elevated to prevent engagement with the ratchet, and to allow the spindle to be rotated in the reverse direction in an unobstructed manner.

(e) A lock assembly, carried between the opposed side rails of the frame on the anchor end axle, prevents the ratchet assembly from turning in the reverse direction unless manually released.

(B) A hook is carried on the spindle of the ratchet assembly. In operation, a point of the slack rope between the anchor and load end grip assemblies may be folded about the hook, causing the rope to be wrapped about the spindle as it is turned by the ratchet. One or more turns of rope may be wrapped about the spindle, taking out the slack between the spindle and the load end grip assembly and causing a frictional connection between the rope and the spindle. At this point, the load end grip assembly may be released, and additional rope wrapped about the spindle by operation of the lever assembly, thereby moving the load upwardly.

(C) An anchor end grip assembly is carried by the the anchor end of the frame and is sized to releasably grip the rope while the load is being moved toward the rope pulling device.

(D) A load end grip assembly is carried by the load end of the frame and is sized to releasably grip the rope while rope is being removed from the spindle as it is being unwound.

It is therefore a primary advantage of the present invention to provide a novel rope pulling device that is attachable to any middle point of a single piece of rope extending from the anchor to the load, and which does not require cutting of the rope into two pieces.

Another advantage of the present invention is to provide a novel rope pulling device that eliminates the need to anchor the load periodically with a second line as the spindle of the ratchet is unwound.

Another advantage of the present invention is to provide a novel rope pulling device that is adaptable for use with lines made of rope, tape, webbing or other materials.

A still further advantage of the present invention is to provide a novel rope pulling device that can be used with a first length of rope that is attached to a load and a second length of rope that is attached to an anchor.

DRAWINGS

These and other features, aspects, and advantages of the present invention will become better understood with regard to the following description, appended claims, and accompanying drawings where:

FIG. 4 is a cross-sectional view of a grip assembly of FIG. 1, seen in the locked position and taken along the 4—4 lines.

FIG. 5 is a cross-sectional view of a grip assembly of FIG. 2, seen in the unlocked position and taken along the 5—5 lines.

DESCRIPTION

Figure 1:
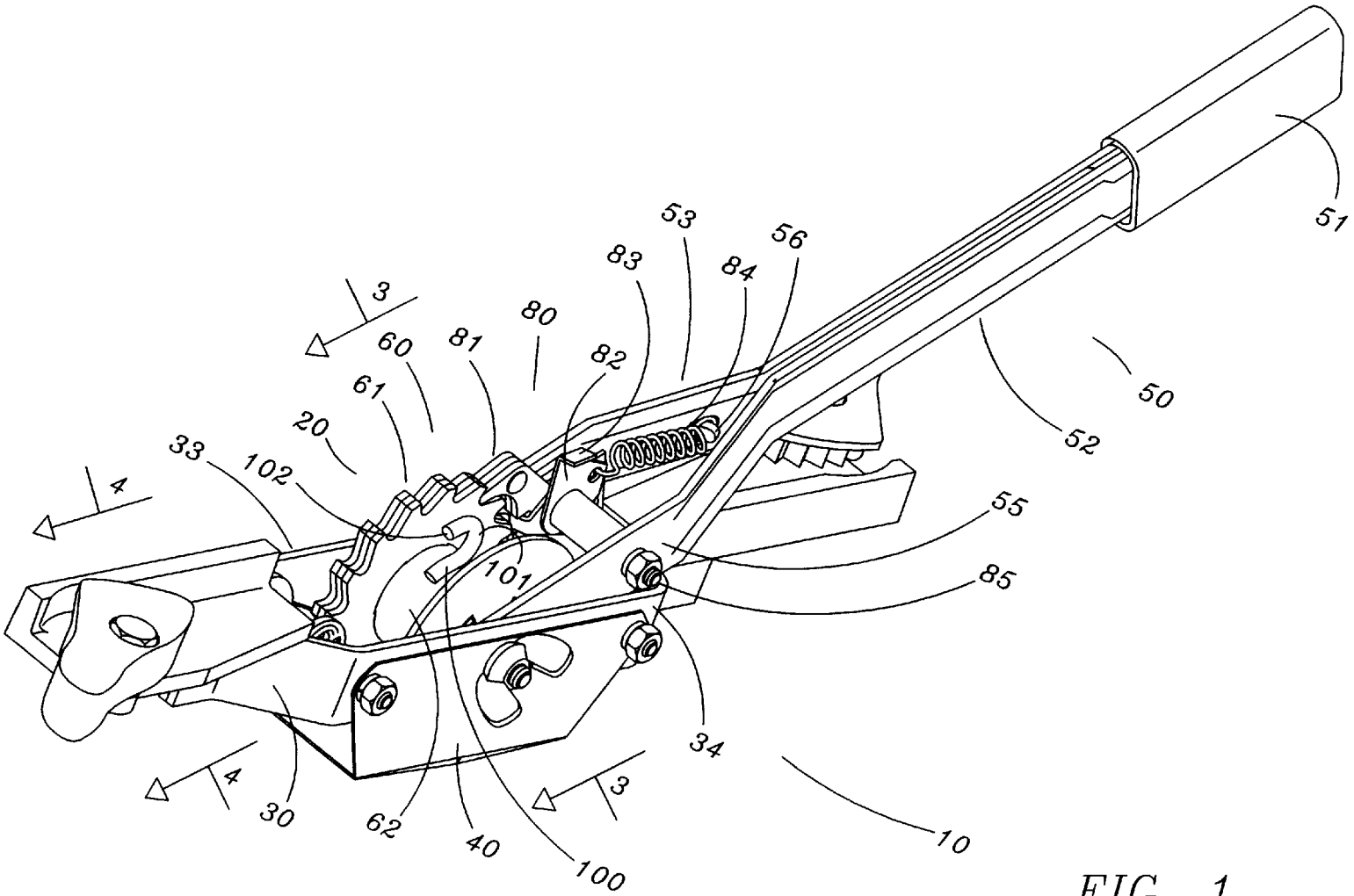
FIG. 1 is a perspective view of a version of the rope pulling device of the invention, showing the anchor end of the rope pulling device in the foreground.

Referring in generally to FIGS. 1 through 6, a rope pulling device constructed in accordance with the principles of the invention is seen. A preferred rope pulling device includes a come-along 20 having a frame 30 on which are mounted an anchor end grip assembly 200 and a load end grip assembly 300. During operation, the anchor end grip assembly is locked on the rope. A hook 100 is carried on the spindle 62 of the ratchet assembly 60. A lever assembly 50 drives a pawl assembly 80 which rotates the ratchet assembly in the forward direction. The hook causes rope to move through the unlocked load end grip assembly and to wind about the spindle. When the spindle is full, the load end grip assembly is locked. A lock assembly 70, which prevents counter-rotation of the spindle is released, allowing the spindle to be reversed and emptied. Slack rope is then passed around the hook, and wound about the spindle for approximately two turns. The load end grip assembly may then be released and the spindle may again be filled with rope, thereby pulling the load 400 closer to the anchor 500.

A come-along 20 is of a generally well-known type, having the cable and having a frame 30 supporting a lever assembly 50. A ratchet assembly 60, carried between opposed side rails 33, 34 of the frame includes a spindle 62 about which rope may be wound. A lock assembly 70, supported by the frame, engages the ratchet assembly to prevent the spindle from unwinding unless the lock 71 is released. A pawl assembly 80, carried by the lever assembly, engages the ratchet assembly to turn the spindle in the direction which results in rope being wound about the spindle.

The rope 600 usable with the spindle 62 includes most commercially available ropes, as well as line in the form of tape, strip and webbing made of natural or synthetic materials.

The frame assembly 30 is generally oriented in a lengthwise manner, having an anchor end 31 and a load end 32. The frame provides a ratchet-side rail 33 and a second side rail 34 which are generally mirror images of each other. The two opposed side rails are connected by anchor end, center, and load end axles 35, 36, 37. The axles separate the rails by a distance sized to contain the lever, ratchet, lock and pawl assemblies.

An enclosure 40 tends to protect the ratchet and lock assemblies, and reduces the chance of injury due to contact with moving parts.

A lever assembly 50 is carried by the center axle 36. A butterfly nut 38, carried on the center axle, allows the quick manual release of the lever assembly for more compact storage of the rope pulling apparatus. The lever assembly includes a lever arm 52 having an upper handle 51 and a lower fork 53. The fork includes first and second prongs 54, 55 which are attached to the rails 33, 34 of the frame, respectively. The forked design of the lever arm prevents undesired lateral movement of the arm during operation.

A fastening tab 56 allows attachment of an upper end of the spring 84 of the pawl assembly.

Pulling movement of the lever arm 52, from the right to the left (as oriented in FIGS. 1 and 2), results in the pawl assembly 80 engaging the ratchet assembly to wind rope about the spindle 62. Reset movement of the lever arm, from the left to the right (as oriented in FIGS. 1 and 2), results in no movement of the spindle.

The ratchet assembly 60 is carried between the opposed side rails of the frame on the center axle 36. A ratchet 61 is carried at one end of the axle, where it may be engaged by the pawl assembly as the lever arm is moved. A spindle 62 is carried on the axle and is attached at one end to the ratchet. The rigid connection between the ratchet and spindle causes both parts to rotate together about the center axle. A region 64 defined between the spindle, the ratchet and an end plate 63 is sized to hold a length of rope wrapped about the spindle.

In its relaxed state, the lock assembly 70 prevents the spindle from turning in the direction which would result in unwinding of any rope wrapped about the spindle, i.e. in clockwise direction as viewed from the lower right of FIG. 1. However, the lock assembly may be manually released, thereby allowing unwinding of the rope carried on the spindle.

The lock assembly provides a lock 71 which is pivotably carried on the anchor end axle 35. A spring 72 biases the lock to pivot to a position where it is held against the ratchet 61, thereby preventing rotation of the ratchet in the reverse (unwinding) direction. The spring may be manually overcome, however, to disengage the lock from the ratchet. While the lock is held in such a position, the ratchet and attached spindle may be rotated in the direction resulting in an unwinding of the rope wrapped about the spindle.

A pawl assembly 80, carried by the lever assembly, is switchable between a winding and an unwinding mode. In the winding mode, a pawl engages the ratchet, forcing it to turn in the forward direction. In the unwinding mode, the pawl is elevated to prevent engagement with the ratchet, and to allow the spindle to be rotated in the reverse direction in an unobstructed manner.

Figure 2:
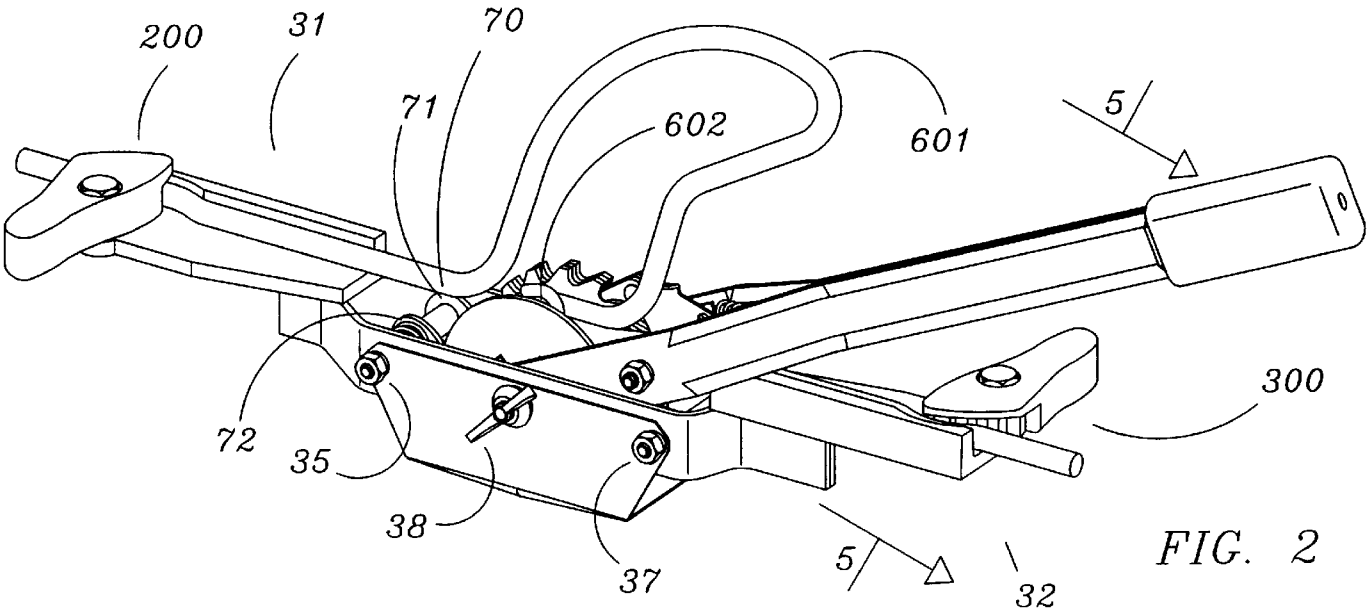
FIG. 2 is a perspective view of the version of the invention of FIG. 1, showing the load end of the rope pulling device in the foreground.
Figure 6:
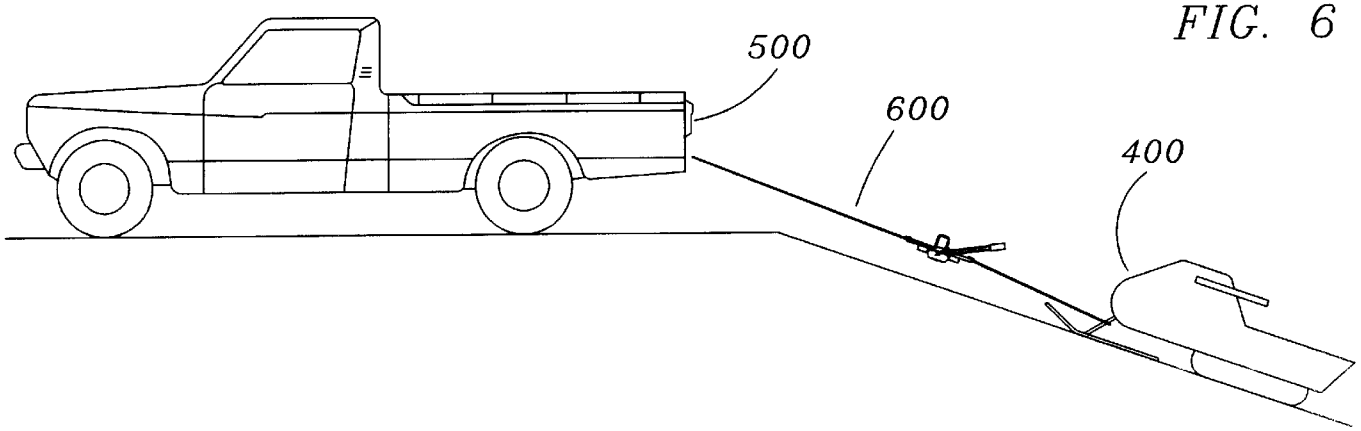
FIG. 6 is a view of the rope pulling device of FIG. 1 in a typical application.
Figure 3:
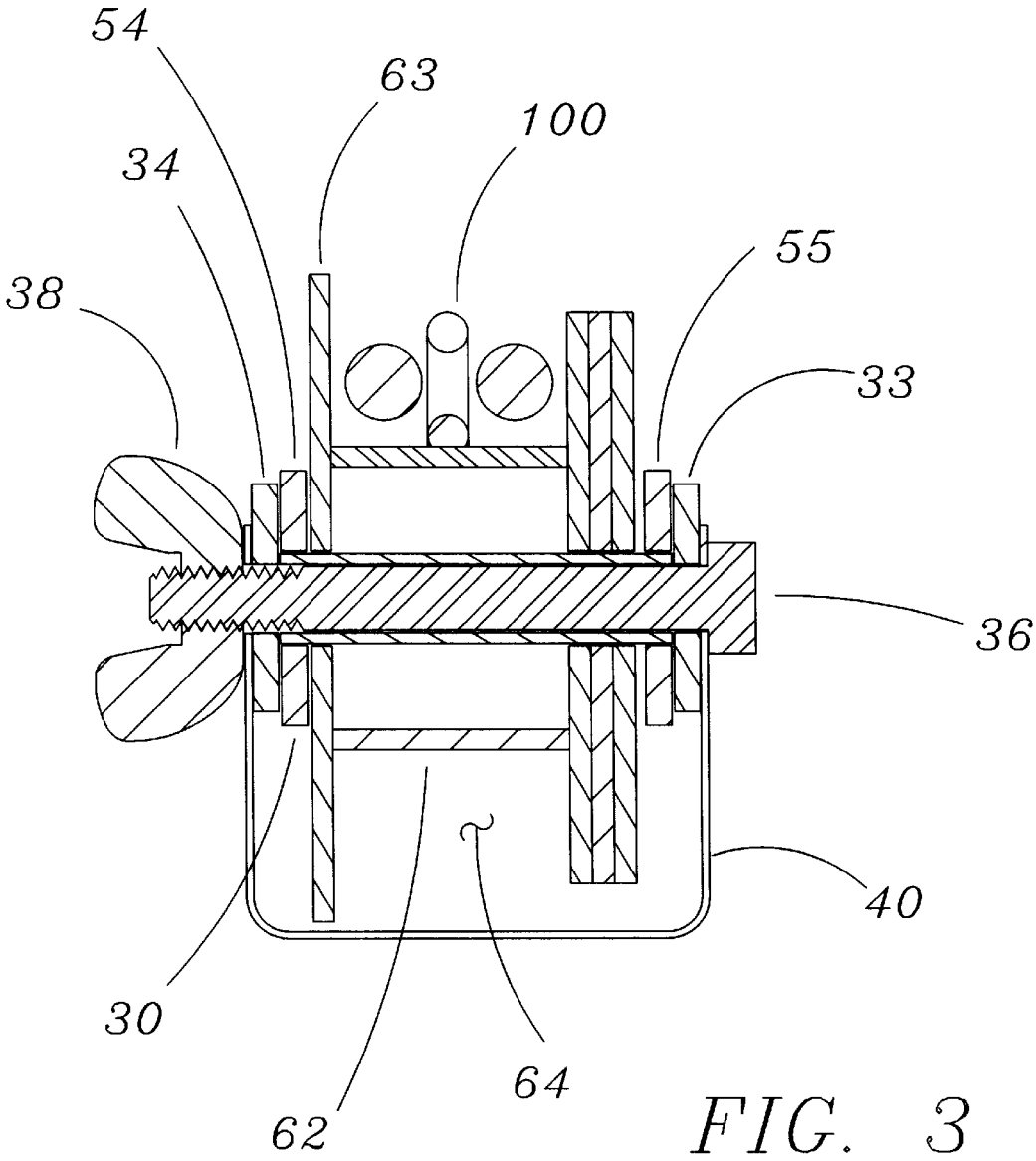
FIG. 3 is a cross-section of the rope pulling device of FIG. 1, taken along the 3—3 lines.

As seen in FIGS. 1 through 3, the pawl assembly provides a pawl 81 supported by an axle 85 carried between the first and second prongs 54, 55 of the handle 51. An adjustment plate 82, attached to the pawl, is connected by a spring 84 to the fastening tab 56 of the handle 51. By moving a handle 83, the pawl may be rotated between first and second positions. In the first position, the pawl engages the ratchet as the handle is moved in the direction associated with pulling movement. In the second position, the pawl does not engage the ratchet.

As seen in FIGS. 1 through 3, a hook 100 is carried on the spindle of the ratchet assembly. The hook provides a curved base 101 and a tip 102. The base and tip are oriented, as seen in FIG. 1, so that when the spindle is turned due to the action of the pawl on the ratchet the hook will pull rope in the direction required to wrap the rope pulling device is in use.

An anchor end grip assembly 200 is carried by the the anchor end of the frame and is sized to releasably grip the rope while the load is being moved toward the rope pulling device.

As seen in FIGS. 1, 2, 4 and 5, a preferred structure of the anchor end grip assembly 200 includes a frame 201 having a sidewall 202. A grip 203 is rotatable about a pivot 204. As seen in FIG. 4, when the rope is in contact with the tread 205, the rope is held in position. Movement of the rope from left to right only results in a tightening of the grip about the rope.

Movement of the handle 206 results in the grip pivoting, as seen in FIG. 5, to a position which allows the rope to freely move.

A load end grip assembly 300 is carried by the the load end of the frame and is sized to releasably grip the rope while the rope is being removed from the spindle and while a couple of turns of rope are being replaced onto the spindle.

As seen in FIGS. 1, 2, 4 and 5, a preferred structure of the anchor end grip assembly 300 includes a frame 301 having a sidewall 302. A grip 303 is rotatable about a pivot 304. As seen in FIG. 4, when the rope is in contact with the tread, the rope is held in position. Movement of the rope from left to right only results in a tightening of the grip about the rope.

Movement of the handle 306 results in the grip pivoting, as seen in FIG. 5, to a position which allows the rope to freely move.

In operation, the anchor 500 and load 400 are attached by a rope 600 having a length of one or more feet longer than the distance between the anchor and load. The rope pulling device is located in a convenient position between the anchor and load. The rope is clamped into the anchor and load end grips 200, 300, after the slack portion 601 of the rope is moved to a location between the grips, as seen in FIG. 2. The portion of the rope extending from the anchor end grip to the anchor is taut, as is the portion of the rope extending from the load end grip to the load.

A fold 602 of the slack rope 601 between the anchor and load end grip assemblies is then folded about the hook. The lever arm 52 is then operated a few times to cause the a portion of the slack rope to be wrapped about the spindle as it is turned by the ratchet. One or more turns of rope may be wrapped about the spindle, taking out the slack between the spindle and the load end grip assembly and causing a frictional connection between the rope and the spindle. At this point, the load end grip assembly automatically releases, due to the motion of the rope, and assumes a configuration similar to that seen in FIG. 5. Additional rope is then wrapped about the spindle by operation of the lever assembly, thereby moving the load upwardly.

If the load has not been moved sufficiently when the region 64 on the spindle is full of rope, the load end grip 303 is moved into a position gripping the rope. The handle 83 on the pawl assembly 80 is moved, thereby releasing the pawl. The lock 71 is released from the ratchet by compressing the spring 72 of the lock assembly 70. With the ratchet released from the lock 71 and pawl 81, the spindle is allowed to turn in the reverse direction, and the rope is then removed.

When the rope is fully removed, the lock 71 is released, thereby locking the ratchet. The pawl assembly is also released by means of handle 83, so that the pawl engages the ratchet.

The rope is then reattached to the spindle by folding a portion of the slack rope between the grip assemblies 200, 300 about the hook. The portion of the rope folded about the hook should be sufficiently distant from the load end grip so that when the handle 51 is used to advance the spindle approximately two turns, the rope between the spindle and load end grip assembly is taut.

The load end grip assembly will automatically release, assuming the position seen in FIG. 5. The lever arm 52 may then be used to wrap additional rope around the spindle, causing the load to move toward the rope pulling device 10.

The previously described versions of the present invention have many advantages, including a primary advantage of providing a novel rope pulling device that is attachable to any middle point of a single piece of rope extending from the anchor to the load, and which does not require cutting of the rope into two pieces.

Another advantage of the present invention is to provide a novel rope pulling device that eliminates the need to anchor the load periodically with a second line as the spindle of the ratchet is unwound.

Another advantage of the present invention is to provide a novel rope pulling device that is adaptable for use with lines made of rope, tape, webbing or other materials.

A still further advantage of the present invention is to provide a novel rope pulling device that can be used with a first length of rope that is attached to a load and a second length of rope that is attached to an anchor.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while preferred versions of the load and anchor end grip assemblies have been disclosed, it is clear that mechanically equivalent versions of such a gripping structure could be substituted. Additionally, while the terms anchor end and load end have been used, it is clear that the rope pulling device is operational where the anchor end of the device is actually attached to the load to be move, and the load end is attached to the non-moving anchor. However, in this configuration, the rope pulling device tends to move relative to the anchor during operation. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A rope pulling device for pulling a rope, the rope pulling device, comprising:

(A) a come-along;

(B) anchor end grip means, carried by an anchor end of a frame portion of the come-along, for gripping the rope;

(C) load end grip means, carried by a load end of the frame portion of the come-along, for gripping the rope; and (D) a hook, carried by a spindle portion of the come-along.

2. A rope pulling device, comprising:

(A) a come-along, comprising:

(a) a frame oriented in a lengthwise manner, having an anchor end and a load end, comprising two opposed side rails;

(b) a lever assembly, carried by an axle supported between the two opposed side rails;

(c) a ratchet assembly, carried between the opposed side rails of the frame on an axle; and (d) a pawl assembly, carried by the lever assembly;

(B) a hook, carried on a spindle of the ratchet assembly;

(C) an anchor end grip assembly, carried by the the anchor end of the frame; and (D) a load end grip assembly, carried by the load end of the frame.

3. A rope pulling device, comprising:

(A) a come-along;

(B) an anchor end grip assembly, carried by an anchor end of a frame portion of the come-along;

(C) a load end grip assembly, carried by a load end of the frame portion of the come-along; and (D) a hook, carried by a spindle portion of the come-along.

* * * * *